US011192751B2

(12) United States Patent
Nakari et al.

(10) Patent No.: US 11,192,751 B2
(45) Date of Patent: Dec. 7, 2021

(54) RESCUE APPARATUS AND AN ELEVATOR

(71) Applicant: KONE Corporation, Helsinki (FI)

(72) Inventors: Arto Nakari, Helsinki (FI); Ari Kattainen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 1181 days.

(21) Appl. No.: 15/649,851

(22) Filed: Jul. 14, 2017

(65) Prior Publication Data

US 2017/0313551 A1 Nov. 2, 2017

Related U.S. Application Data

(63) Continuation of application No. PCT/FI2015/050026, filed on Jan. 16, 2015.

(51) Int. Cl.

| | |
|---|---|
| ***B66B 5/02*** | (2006.01) |
| ***B66B 1/32*** | (2006.01) |
| ***B66D 5/30*** | (2006.01) |
| ***B66D 5/08*** | (2006.01) |
| ***B66B 5/08*** | (2006.01) |

(52) U.S. Cl.

CPC ..... *B66B 5/027* (2013.01); *B66B 1/32* (2013.01); *B66B 5/08* (2013.01); *B66D 5/08* (2013.01); *B66D 5/30* (2013.01)

(58) Field of Classification Search

CPC .. B66B 5/027; B66B 1/32; B66B 5/08; B66D 5/08; B66D 5/30

See application file for complete search history.

(56) References Cited

U.S. PATENT DOCUMENTS

| | | | | |
|---|---|---|---|---|
| 4,220,222 | A | 9/1980 | Kamaike et al. | |
| 6,364,066 | B1 * | 4/2002 | Bolch | B66B 5/0018 187/391 |
| 2006/0201752 | A1 | 9/2006 | Helstrom | |
| 2008/0185233 | A1 * | 8/2008 | Tegtmeier | B66B 1/3492 187/290 |

(Continued)

FOREIGN PATENT DOCUMENTS

| | | | |
|---|---|---|---|
| JP | 1-313283 | A | 12/1989 |

OTHER PUBLICATIONS

International Search Report, issued in PCT/FI2015/050026 (PCT/ISA/210), dated Mar. 24, 2015.

(Continued)

*Primary Examiner* — Jeffrey Donels

(74) *Attorney, Agent, or Firm* — Birch, Stewart, Kolasch & Birch, LLP

(57) ABSTRACT

The invention concerns a rescue apparatus, an elevator as well as a retrofit kit. The rescue apparatus comprises a brake control unit having input terminals for connecting to a power supply, output terminals for connecting to a magnetizing coil of an electromagnetic brake, at least one controllable brake opening switch associated with at least one of the input terminals and adapted, in an open state, to prevent supply of current from the power supply to the magnetizing coil and, in a closed state, to allow supply of current from the power supply to the magnetizing coil. The rescue apparatus further comprises a control cable comprising one or more control signal wires and a remote control panel coupled via the control cable to the brake control unit.

20 Claims, 4 Drawing Sheets

(56) References Cited

U.S. PATENT DOCUMENTS

| | | | | |
|---|---|---|---|---|
| 2008/0202859 | A1 | 8/2008 | Tegtmeier et al. | |
| 2012/0080273 | A1* | 4/2012 | Herkel | B66B 1/34 187/247 |
| 2017/0313548 | A1* | 11/2017 | Nakari | B66B 5/00 |
| 2017/0313551 | A1* | 11/2017 | Nakari | B66B 1/32 |
| 2018/0134519 | A1* | 5/2018 | Kattainen | B66B 9/00 |
| 2018/0334359 | A1* | 11/2018 | Nikander | B66B 5/0087 |
| 2019/0023531 | A1* | 1/2019 | Pokkinen | B66B 5/0031 |
| 2019/0337760 | A1* | 11/2019 | Zhu | F16D 65/186 |

OTHER PUBLICATIONS

Written Opinion of the International Searching Authority, issued in PCT/FI2015/050026 (PCT/ISA/237), dated Mar. 24, 2015.

* cited by examiner

RESCUE APPARATUS AND AN ELEVATOR

CROSS REFERENCE TO RELATED APPLICATIONS

This application is a Continuation of PCT International Application No. PCT/FI2015/050026, filed on Jan. 16, 2015, which is hereby expressly incorporated by reference into the present application.

FIELD OF THE INVENTION

The subject matter described herein relates to rescue apparatuses for elevators, that is, apparatuses for rescuing elevator passengers from an elevator car.

BACKGROUND

Sometimes an operational anomaly, such as a power failure may cause stopping of elevator car between landings, outside of the appropriate stopping area. One solution for remedying this situation is to open the hoisting machinery brakes manually by means of a manual brake release lever. Opening of the machinery brakes causes movement of elevator car towards the closest landing by means of gravity.

The brake lever may be located, for example, in elevator landing area, outside the elevator shaft. The brake lever is connected to the hoisting machinery brakes via a brake-opening wire (mechanical cable wire) such that the brake-opening wire mechanically pulls the machinery brakes open, when the lever is turned.

The serviceman keeps the machinery brakes open by pulling the lever, observes elevator car movement visually and returns the lever back to initial position to stop the elevator car when the elevator car arrives to door zone. When in the door zone, elevator car floor is at the same level with landing floor such that passengers can exit from the elevator car to the landing.

This kind of brake opening mechanism must be located not too far from the hoisting machinery brakes; otherwise the length of the brake-opening wire might cause problems. When length of the brake opening wire increases, force needed to turn the lever increases also. Dirt, corrosion etc. might easily block movement of very long brake-opening wire, therefore complicating brake opening process/rescue operation.

On the other hand, sometimes it would be beneficial to dispose manual brake opening interface (e.g. brake lever) far from the hoisting machinery brakes. For example, in some elevators it is desired to locate the manual brake opening interface at the lowest landing while the hoisting machine/machinery brakes are located in upper part of the elevator shaft.

Smooth rescue operation requires some experience in brake lever usage. Consequently, there is a need for more easy to use device, however with same uncompromised safety.

AIM OF THE INVENTION

In view of the foregoing, it is the objective of this invention to introduce an improved rescue apparatus for an elevator, providing flexible placement of the manual brake opening interface (hereinafter referred to as "remote control unit") relative to hoisting machinery brake(s). Therefore the invention discloses a rescue apparatus, an elevator and a retrofit kit. Some preferred embodiments of the invention are described in the dependent claims. Some inventive embodiments, as well as inventive combinations of various embodiments, are presented in the specification and in the drawings of the present application.

SUMMARY OF THE INVENTION

An aspect of the invention is a rescue apparatus for an elevator, the rescue apparatus comprising a brake control unit having input terminals for connecting to a power supply, output terminals for connecting to a magnetizing coil of an electromagnetic brake and at least one controllable brake opening switch associated with at least one of the input terminals and adapted, in a first switching state, to prevent supply of current from the power supply to the magnetizing coil and, in a second switching state, to allow supply of current from the power supply to the magnetizing coil. The rescue apparatus comprises also a control cable comprising one or more control signal wires and a remote control panel coupled via the control cable to the brake control unit. The remote control panel comprises a manually operated drive switch coupled via the control signal wire of the control cable to the control pole of the brake opening switch.

Another aspect of the invention is an elevator, comprising an elevator car and a hoisting machine configured to drive the elevator car in elevator shaft between landings according to service requests from elevator passengers, the hoisting machine including one or more electromagnetic brakes. The elevator comprises a rescue apparatus according to the disclosure.

Still another aspect of the invention is a retrofit kit comprising a rescue apparatus according to the disclosure, which rescue apparatus is suitable for fitting into an elevator according to the disclosure. This means that the rescue apparatus according to the disclosure may be introduced into old elevator installations to update the rescue functionality.

The rescue apparatus disclosed is simple in structure; therefore the operation of the rescue apparatus can be analyzed in details to reach high level of safety. The rescue apparatus is also suitable for installation to various kinds of elevators, because location of the remote control unit can be selected substantially freely relative to the brake control unit, e.g. the length of the control cable is not a limiting factor in the same way as is the case with traditional brake levers with mechanical brake-opening wires. In a preferred embodiment, the controllable brake opening switch(es) of the brake control unit is/are safety relays. This kind of relays have mechanical contacts with high isolating distances, therefore ensuring high reliability in magnetizing coil current cut-off procedure. Therefore also reliable operation of the hoisting machinery brake(s) can be achieved during rescue operation.

According to an embodiment, the brake control unit comprises two controllable brake opening switches, which are both adapted to prevent supply of current to the magnetization coil independent of each other, and the remote control panel comprises two manually operated drive switches, one of the drive switches being coupled via a first control signal wire to a control pole of the first brake opening switch and the other being coupled via a second control signal wire to a control pole of the second brake opening switch. This means that magnetizing coil current can be interrupted with two independent means (the brake opening switches), controlled (with the drive switches, via separate control signal wires) independent of each other. Therefore, if one of the brake opening switches is for some reason stuck in closed position, the other brake opening switch is still operational and can apply the brake by interrupting the magnetizing coil current.

According to an embodiment, the brake control unit comprises a switching state indicator for indicating the switching state of the brake opening switches.

According to an embodiment, the remote control panel comprises a manually operated mode selection switch connected in series with the one or more drive switches. This means that rescue operation with the drive switch(es) is not possible until the mode selection switch has been turned to rescue position.

According to an embodiment, the power supply is a backup power supply. This means that rescue operation is possible also during power failure of the mains, by supplying current to the magnetizing coil(s) from the backup power supply.

According to an embodiment, the power supply is a DC backup power supply, and in that the main circuit comprises a DC/DC converter for supplying electricity from the backup power supply to the magnetization coil. This means that the DC/DC converter can be used to convert low voltage of DC backup power supply to a higher voltage for the magnetizing coil(s). In a preferred embodiment, the DC backup power supply is a battery.

According to an embodiment, the power supply is mains. In a preferred embodiment, both mains and backup power supply are connectable to the input terminals. In an embodiment, the control unit is configured such that power is supplied from the backup power supply only in case of power failure of the mains, and otherwise power is supplied from the mains.

According to an embodiment, the brake control unit further comprises passage terminals for output cables of a normal mode brake control device as well as a disconnecting switch fitted between the passage terminals and the output terminals. Control pole of the disconnecting switch is coupled via a control signal wire to the mode selection switch in the remote control panel, such that the disconnecting switch is operable to selectively disconnect or connect the passage terminals to the output terminals based on status of the mode selection switch. This means that the normal mode brake opening device can be separated from current supply circuit of the magnetizing coil in rescue mode, by turning the mode selection switch into rescue mode. Therefore rescue operation is still possible even if the normal mode brake opening device is faulty, for example if output of the normal mode brake opening switch is short-circuited.

According to an embodiment, the disconnecting switch is a changeover switch having first inputs coupled to the passage terminals, second inputs coupled to the rescue-time current and outputs coupled to output terminals. This means that the brake control unit is separated from the normal brake opening device also during normal elevator operation, when the mode selection switch is turned into normal mode. This reduces failure probability of the brake control unit.

According to an embodiment, the mode selection switch has a contact in elevator safety chain. The safety chain contact of the mode selection switch is fitted to be in open state when the mode selection switch is in rescue mode and to be in closed state when the mode selection switch is in normal mode. This means that normal elevator operation can be prevented during the rescue operation by turning the mode selection switch into rescue mode, which interrupts the elevator safety chain.

According to an embodiment, the rescue apparatus comprises controllable dynamic braking switches having terminals for coupling to a stator winding of a permanent magnet motor, the dynamic braking switches being adapted to generate, in a closed state, a braking current from electromotive force of the permanent magnet motor, wherein the control pole(s) of the dynamic braking switches are coupled to the elevator safety chain such that the dynamic braking switches are in the closed state when the elevator safety chain is interrupted. This means that dynamic braking can be activated from the remote control unit by turning the mode selection switch into rescue mode, thus interrupting the elevator safety chain. Therefore also elevator car speed/acceleration can be reduced during rescue operation by means of the dynamic braking, which leads to longer opening/closing intervals for the hoisting machinery brake(s) (e.g. brake opening/closing frequency can lower without causing activation of safety gear because of overspeed, which means that rescue operation is easier to perform).

According to an embodiment, the control cable comprises a power supply wire coupled to the backup power supply, and the remote control unit comprises an indicator of backup power supply status. This means that operating condition of the backup power supply (e.g. battery) can be monitored from the remote control unit. This is especially useful in cases when the backup power supply is disposed in elevator shaft and remote control unit is disposed in landing floor, outside the elevator shaft.

According to an embodiment, the brake control unit comprises a solid state switch associated with the output terminals for selectively preventing or allowing supply of electricity to the magnetizing coil. This means that power supply to the magnetizing coil can be interrupted/resumed with the solid state switch also. Use of mechanical brake opening switch(es) is necessary only in selected operating situations, for example when releasing the drive switch(es) in the remote control unit. If the mechanical brake opening switch(es) is/are used only when necessary, and otherwise using the solid state switch, number of switching events of the mechanical brake opening switch(es) can be reduced and life time of them can be increased.

According to an embodiment, the brake control unit comprises a safety logic having output coupled to the control pole of the solid state switch and an input coupled to the switching state indicator, for receiving switching state information of the brake opening switches. The safety logic comprises a logic element configured to compare the received switching states of the brake opening switches and to block power supply to the output terminals in case one of the brake opening switches remains in closed state while the other changes from closed state to open state and then returns to the closed state. This means that supply of current to the magnetizing is prevented with the solid state switch and therefore brake is not opened if both brake opening switches do not open between consecutive rescue runs (e.g. when one brake opening switch opens interrupting current supply to the magnetizing coil, also the other has to open before current supply to the magnetizing coil can be resumed again). This way it is possible to detect if one of the brake opening switches has failed and stuck in closed position. Thereby safety of the rescue apparatus can be increased.

According to an embodiment, the brake control unit comprises a modulator coupled to the control pole of the solid state switch. The modulator is configured to adjust output terminal voltage by modulating the solid state switch. This means that it is possible to reduce output terminal voltage/magnetizing current after brake has opened. When brake has opened, a smaller magnetizing coil current is adequate to keep the brake open. Thus, by reducing the magnetizing current to a smaller value, which is however adequate to keep the brake open, power losses of the magnetizing coil can be reduced and rise of brake coil temperature can be reduced.

According to an embodiment, the remote control unit is disposed in the landing. This means that also rescue operation can be performed from the landing, outside of the elevator shaft.

According to an embodiment, the hoisting machine, the normal mode brake controller, the brake control unit and the backup power supply are disposed in shaft, in close proximity to each other. This means that only short power supply cables are required between them, which simplifies the electrification and reduces possible EMC disturbances.

BRIEF DESCRIPTION OF THE DRAWINGS

In the following, the invention will be described in more detail by the aid of some examples of its embodiments, which in themselves do not limit the scope of application of the invention, with reference to the attached drawings, wherein.

MORE DETAILED DESCRIPTION OF PREFERRED EMBODIMENTS OF THE INVENTION

For the sake of intelligibility, in FIGS. 1-4 only those features are represented which are deemed necessary for understanding the invention. Therefore, for instance, certain components/functions which are widely known to be present in corresponding art may not be represented.

In the description same references are always used for same items.

Figure 1:
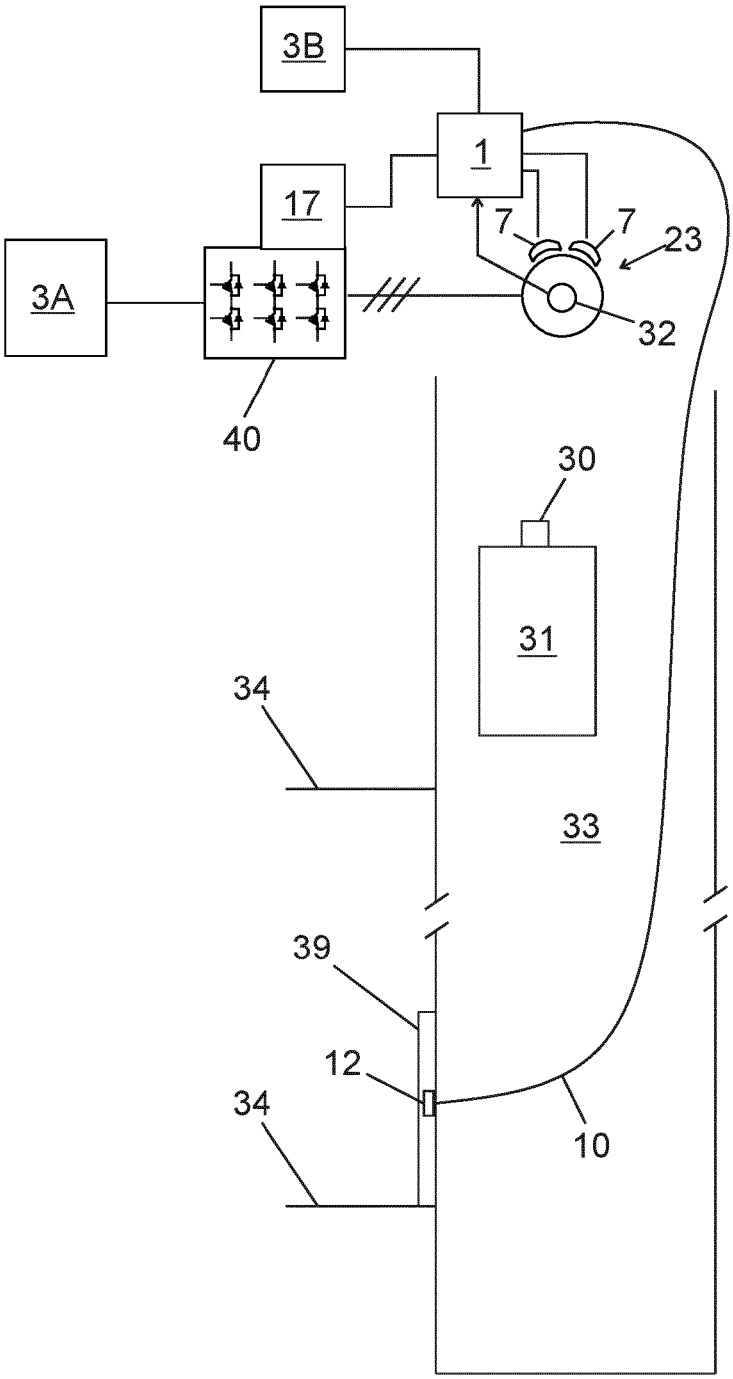
FIG. 1 shows a schematic of an elevator according to an embodiment.

FIG. 1 is a schematic of an elevator according to an exemplary embodiment. The elevator comprises an elevator car 31 and an elevator drive. Main elements of the elevator drive are further shown in FIG. 4. Thus, the elevator drive includes a hoisting machine 23 and a frequency converter 40. The hoisting machine 23 is configured to drive the elevator car 31 in elevator shaft 33 between landings 34 according to service requests from elevator passengers, as is known in the art.

The frequency converter 40 and the hoisting machine 23 are mounted near the top end of elevator shaft 33. Hoisting machine 23 includes a permanent magnet motor 22 and a rotating traction sheave (not shown), mounted to the axis of the permanent magnet motor 22. Frequency converter 40 is connected to the stator 21 of the permanent magnet motor 22 for supplying power to the permanent magnet motor 22. Elevator car 31 and counterweight (not shown) are suspended with hoisting roping (not shown). Hoisting roping runs via traction sheave of the hoisting machine 23. The permanent magnet motor 22 drives the traction sheave, thereby causing elevator car 31 and counterweight to move in opposite directions in elevator shaft 33.

Alternatively, hoisting machine 23 and frequency converter 40 may be disposed in the elevator shaft pit. The elevator system may also have separate hoisting roping and suspension roping. In this case the hoisting roping may run via the traction sheave of hoisting machine 23 disposed in the pit. Further, the suspension roping may be coupled to at least one pulley near top end of the shaft. The term "roping" is understood to refer to traditional circular ropes as well as belts. Alternatively, hoisting machine 23 and frequency converter 40 may be disposed in a machine room separate from shaft 33.

The elevator according to the disclosure may also be implemented without a counterweight.

Figure 3:
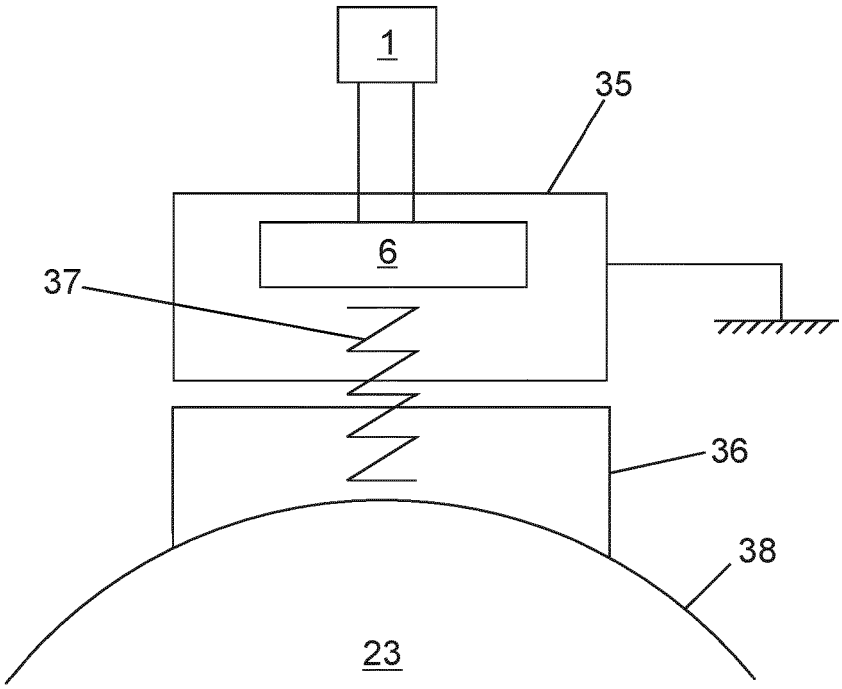
FIG. 3 shows basic operational elements of an electromagnetic brake according to an embodiment.

Hoisting machine 23 of FIG. 1 comprises two electromagnetic brakes 7 for braking of movement of the traction sheave. One of the brakes 7 is shown in FIG. 3. The electromagnetic brake 7 includes a stationary brake body 35, which is fixed to stationary body of the hoisting machine 23, and an armature 36 arranged to move relative to the brake body 35. A spring 37 is fitted between the brake body 35 and the armature 36 to apply a thrust force between them. An electromagnet with magnetizing coil 6 is fitted inside the brake body 35. Brakes 7 are applied by driving the armature against the braking surface 38 of rotating part of hoisting machine 23 by means of the thrust force of the spring 37. Brake 7 is opened by energizing the magnetizing coil 6. When energized, magnetizing coil 6 causes attraction between the brake body 35 and the armature 36, which attraction further causes armature 36 to disengage the braking surface 38 by resisting thrust force of the spring 37.

A normal mode brake controller 17 is connected to magnetizing coils 6 of the brakes 7 to selectively open or close brakes 7 during normal elevator operation. The normal mode brake controller 17 is disposed in frequency converter 40, in close proximity to hoisting machine 23 and brakes 7. In some alternative embodiments the normal mode brake controller 17 is disposed in a control panel mounted in elevator landing 34. In normal mode, the brakes 7 are opened when starting a new elevator run, and brakes 7 are applied at the end of the run to hold elevator car 31 at standstill. The brakes 7 are controlled open by supplying required amount of current to the magnetizing coils 6. The brakes 7 are applied by interrupting the current supply.

In a functional nonconformance run of elevator car 31 may be interrupted in such a way that the elevator car 31 becomes jammed outside landing 34, such that the elevator passengers in the elevator car 31 are not able the leave the elevator car 31. A functional nonconformance may be caused e.g. by an electricity outage of the mains 3A, or by an operating error or failure of the elevator control system, for example. For this reason the elevator of FIG. 1 has a rescue apparatus for performing a rescue operation in which a serviceman safely returns the jammed elevator car to a landing 34 such that passengers can exit the car 31. This happens by opening the brakes 7 to move elevator car 31 by means of gravity.

The rescue apparatus comprises a brake control unit 1, a remote control unit 12 and a backup battery 3B. The brake control unit 1 and the backup battery 3B are disposed in shaft 33, in close proximity to the hoisting machine 23/brakes 7 and the normal mode brake controller 17. The remote control unit 12 is disposed outside of the elevator shaft 33, in a control panel 39 mounted to landing door frame of the pit entrance. The remote control unit 12 is coupled to the brake control unit 1 via a control cable 10.

Figure 2:
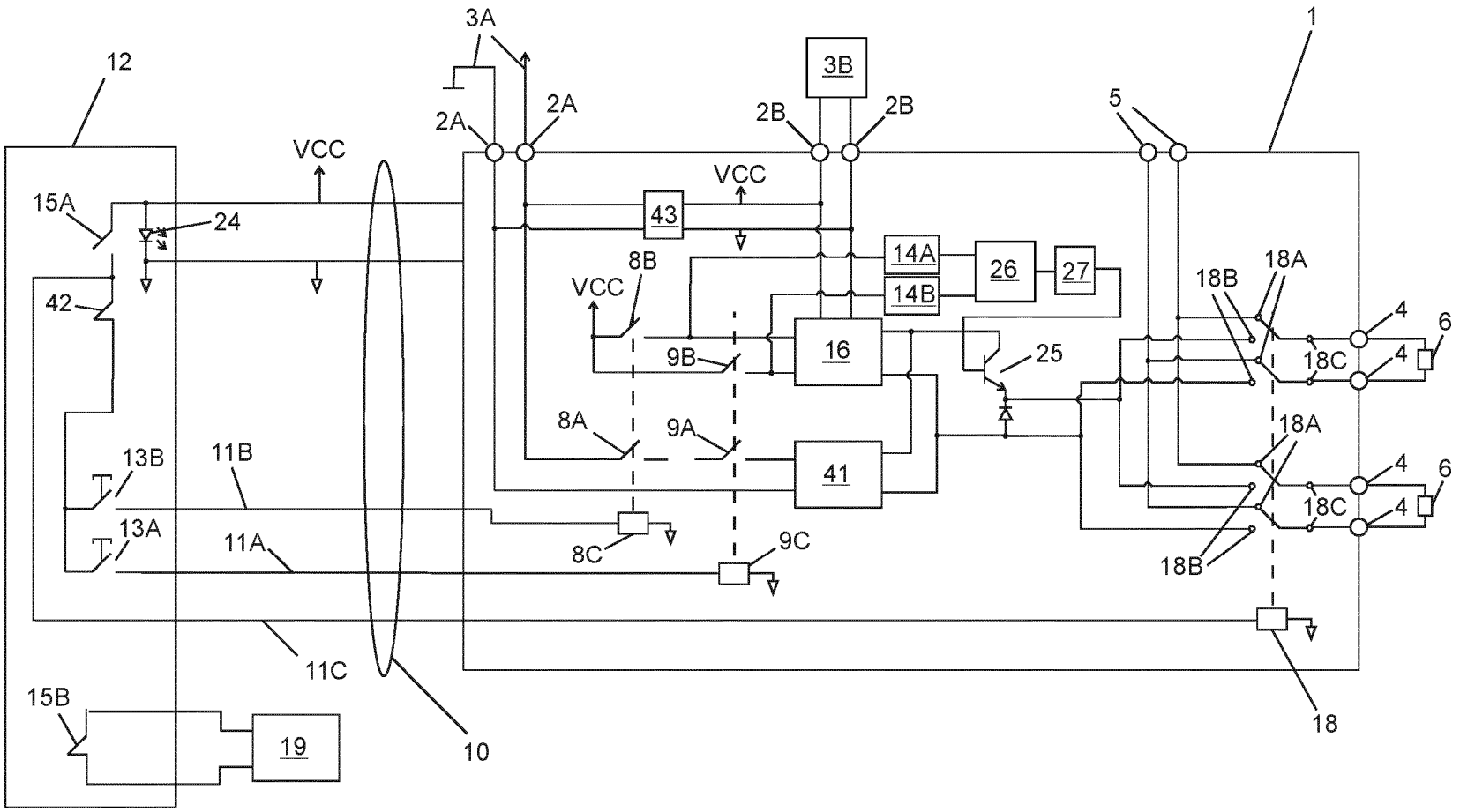
FIG. 2 shows a circuit diagram of a rescue apparatus according to an embodiment.

FIG. 2 shows circuit diagram of the rescue apparatus of FIG. 1. The brake control unit 1 has input terminals 2A connected to the mains 3A as well as input terminals 2B connected to the backup battery 3B. The mains 3A may be, for example, a 230 V AC voltage network. The brake control unit 1 has also output terminals 4 connected to the magnetizing coils 6 of the two electromagnetic brakes 7. The brake control unit 1 has also a solid state switch in the form of igbt transistor 25, which is associated with the output terminals 4 for selectively preventing or allowing supply of electricity to the magnetizing coils 6.

A DC/DC converter 16 is coupled between the input terminals 2B and the solid state switch 25. The DC/DC converter 16 supplies current from the backup battery 3B to the igbt transistor 25 input. At the same time DC/DC converter 16 also converts battery 3B voltage to a higher DC voltage value required for the magnetizing coils 6. During normal elevator operation, battery 3B is charged with battery charger 43.

The brake control unit 1 comprises two controllable brake opening switches 8A, 8B; 9A, 9B in the form of safety relays. Both relays have two safety contacts 8A, 8B; 9A, 9B. The safety contacts 8A, 8B; 9A, 9B are associated with the corresponding input terminals 2A, 2B. Each safety relay 8A, 8B; 9A, 9B is adapted to prevent supply of current to the corresponding magnetizing coil 6 independent of other safety relay. This means that if one of the safety relays 8A, 8B; 9A, 9B has a safety contact stuck in closed position, the other one 8A, 8B; 9A, 9B is still operational and can apply the brake 7 by interrupting current of the magnetization coil 6.

The safety contacts 8A, 8B; 9A, 9B are normal open (N.O.) contacts. They are fitted to the main circuit of the brake control unit 1 such that in an open state they prevent supply of current to the magnetizing coils 6 and in a closed state they allow supply of current to the magnetizing coils 6.

The control cable 10 comprises control signal wires 11A, 11B, 11C. Control signals are sent from the remote control panel 12 to the brake control unit 1 via the control signal wires 11A, 11B, 11C as disclosed hereinafter.

The remote control unit 12 comprises two manually operated drive switches 13A, 13B. One of the drive switches 13B is coupled via a first control signal wire 11B to a control pole 8C of the first brake opening switch 8A, 8B and the other is coupled via a second control signal wire 11A to a control pole 9C of the second brake opening switch 9A, 9B. The remote control unit 12 comprises also a manually operated mode selection switch, which has a contact 15A connected in series with the drive switches 13A, 13B. The mode selection switch 15 has two modes (positions), normal mode (enabling normal elevator operation) and rescue mode (enabling rescue operation). The mode selection switch contact 15A is in closed state in rescue mode and in open state in normal mode. When mode selection switch contact 15A is closed, drive switches 13A, 13B receive DC supply voltage VCC. The DC supply voltage VCC comes from backup battery 3B via control cable wire 11D.

When drive switch contacts 13A, 13B are manually closed (by operating the manual push buttons), control voltage VCC is connected via the control cable wires 11A, 11B to the control coils 8C, 9C of the brake opening switch safety relays, causing closing of the safety contacts 8A, 8B; 9A, 9B. This has two effects: on the one hand current can flow from mains 3A to igbt transistor 25 through the safety contacts 8A, 9A and a diode bridge rectifier 41. At the same time, closing of safety contacts 8B, 9B connects control voltages of the DC/DC converter 16, therefore enabling operation of the DC/DC converter.

The remote control unit 12 comprises an indicator 24 of VCC voltage status, which also indicates status of the backup battery 3B. The indicator 24 can be for example a led. By means of the indicator 24 it is possible to check condition of the backup battery 3B without going into elevator shaft 33.

The remote control unit 12 also has an overspeed governor switch 42. Overspeed governor switch 42 opens at a predetermined overspeed lever, causing opening of the safety relay contacts 8A, 8B; 9A, 9B.

A modulator 27 is coupled to the control pole of the igbt transistor 25. The modulator 27 turns the igbt transistor 25 on and off with a high switching frequency according to a specific switching pattern to adjust output terminal 4 voltage. Therefore, the output terminal 4 voltage may be reduced to avoid excessive power losses in the magnetizing coils 6. On the other hand, the output terminal 4 voltage may be temporary raised to make sure that the machinery brakes 7 open properly. The switching pattern depends on the modulation method used, as a skilled person understands. Suitable modulation methods known in the art are, for example, pulse width modulation, frequency modulation and hysteresis modulation.

The brake control unit 1 comprises a switching state indicator 14 for indicating the switching state of the safety contacts 8A, 8B; 9A, 9B. The switching state indicator 14 includes optocouplers 14A, 14B coupled to the safety contacts 8B, 9B.

The brake control unit 1 further comprises a safety logic 26. The safety logic 26 has an output coupled to the modulator 27 to selectively enable or prevent control signals to the control pole of the igbt transistor 25. Inputs of the safety logic 26 are coupled to outputs of the optocouplers 14A, 14B. The safety logic 26 has a logic circuit, which may be in the form of discrete IC circuits, a microcontroller and/or an FPGA, for example. The logic circuit is configured to compare the switching states of the safety contacts 8B, 9B and to block supply of current through the igbt transistor 25 in case one of the safety relay contacts 8B, 9B remains in closed state while the other 8B, 89B changes from closed state to open state and then returns to the closed state. This particular logic makes it possible to detect if one of the brake opening switches 8A, 8B; 9A, 9B has failed and is stuck in closed position. Further, in that case opening of the brakes 7 is prevented to ensure elevator safety.

Current is supplied from normal mode brake control device 17 to the magnetizing coils 6 via the brake control unit 1. In rescue mode, the normal mode brake control device 17 is isolated from the magnetizing coils 6 and the brake control unit 1 is connected to the magnetizing coils 6 such that brake control unit 1 may supply current to the magnetizing coils 6 without any interference from normal mode brake control device 17. Consequently, in normal mode the brake control unit 1 is isolated from the magnetizing coils 6 and the normal mode brake control device 17 is connected to the magnetizing coils 6 such that the normal mode brake control device 17 may supply current to the magnetizing coils 6 without any interference from the brake control unit 1. This isolation function is implemented in brake control unit 1 as disclosed hereinafter.

Current supply cables from the normal mode brake control unit 1 are connected to passage terminals 5 of the brake control unit 1. Current supply cables of the magnetizing coils 6 are further connected to output terminals 4 of the brake control unit 1. The brake control unit 1 comprises a changeover switch 18 having first inputs 18A, second inputs 18B and outputs 18C. The first inputs 18A are coupled to the passage terminals 5 and the second inputs 18B are coupled to rescue-time current supply, e.g. to the current path from the input terminals 2A, 2B. In the embodiment of FIG. 2 the second inputs 18B are coupled to the emitter of the igbt transistor 25. The outputs 18C of the changeover switch 18 are coupled to output terminals 4.

Control pole 18D of the disconnecting switch is coupled via a control signal wire 11C to the manually-operated mode selection switch 15A in the remote control panel 12.

When the mode selection switch 15A is turned into normal operation state (open state), current is supplied from the normal mode brake control device 17 through the first inputs 18A of the changeover switch 18 further via output terminals 4 to the magnetizing coils 6. At the same time the second inputs 18B remain open, thereby isolating magnetizing coils 6 from the igbt transistor 25.

When the mode selection switch 15A is turned into rescue operation state (closed state), current is supplied from the input terminals 2A, 2B through the igbt transistor 25 and the second inputs 18B further via output terminals 4 to the magnetizing coils 6. At the same time the first inputs 18A remain open, isolating magnetizing coils 6 from the normal mode brake control device 17.

One of the mode selection switch contacts 15B is in elevator safety chain 19. In the disclosure the term "elevator safety chain" has to be understood broadly, including traditional serial connection circuits of elevator safety contacts as well as modern programmable electronic safety devices enabled in new elevator safety codes. The switch contact 15B is closed during normal elevator operation and opened in rescue mode. Open switch contact 15B means that elevator safety chain 19 is interrupted. When interrupted, safety chain 19 blocks normal elevator operation, thereby enhancing safety of the rescue operation.

Figure 4:
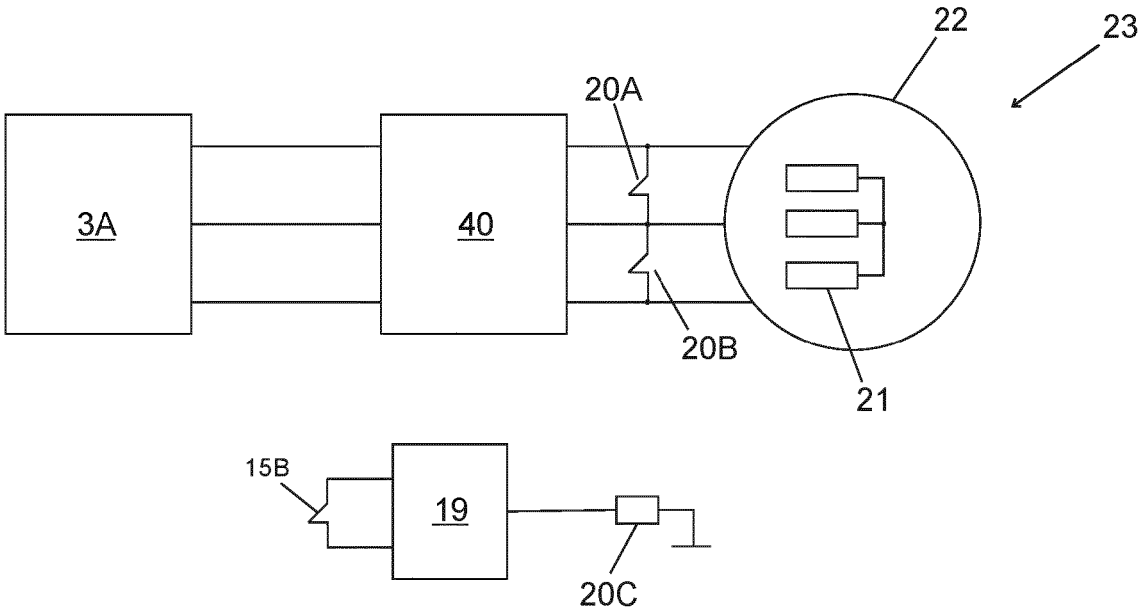
FIG. 4 shows an elevator drive according to an embodiment.

The rescue apparatus of FIG. 1 also comprises dynamic braking switches 20A, 20B. The dynamic braking switches 20A, 20B are used to brake rotation of hoisting machine 23 during rescue operation, to stabilize elevator car movement during rescue operation. Connecting principle of the dynamic braking switches 20A, 20B is represented in FIG. 4. When closed, the dynamic braking switches generate a braking current from electromotive force of the permanent magnet motor 22 of the hoisting machine 23.

Terminals of the dynamic braking switches 20A, 20B are coupled to the stator winding 21 of the permanent magnet motor 22. In the embodiment of FIG. 4, the dynamic braking switches 20A, 20B are normal-closed (N.C.) contacts of a contactor or a relay. This means that dynamic braking is always possible even when no control voltage is available, e.g. during power outage. On the other hand, instead of mechanical switches also solid state switches (such as igbt transistors, mosfet transistors, gallium-nitride transistors, silicon-carbide transistors etc.) could be used. The control coil 20C of the dynamic braking contactor is coupled to the elevator safety chain 19. Current to the control coil 20C is interrupted to enable dynamic braking when switch contact 15B is opened (e.g. during rescue operation).

The invention is described above by the aid of exemplary embodiments. It is obvious to a person skilled in the art that the invention is not limited to the embodiments described above and many other applications are possible within the scope of the inventive concept defined by the claims.

The invention claimed is:

1. A rescue apparatus for an elevator, the rescue apparatus comprising:

a brake control unit comprising:

input terminals for connecting to a power supply;

output terminals for connecting to a magnetizing coil of an electromagnetic brake; and at least one controllable brake opening switch associated with at least one of the input terminals and adapted, in an open state, to prevent supply of current from the power supply to the magnetizing coil and, in a closed state, to allow supply of current from the power supply to the magnetizing coil;

a control cable comprising one or more control signal wires; and a remote control panel coupled via the control cable to the brake control unit, wherein the remote control panel comprises a manually operated drive switch coupled via the control signal wire to the control pole of the at least one controllable brake opening switch, and wherein the at least one controllable brake opening switch includes a first controllable brake opening switch and a second controllable brake opening switch, both the first controllable brake opening switch and the second controllable brake opening switch being adapted to prevent supply of current to the magnetizing coil independent of each other.

2. The rescue apparatus according to claim 1, wherein the remote control panel comprises two manually operated drive switches, one of the drive switches being coupled via a first control signal wire to a control pole of the first controllable brake opening switch and the other of the drive switches being coupled via a second control signal wire to a control pole of the second controllable brake opening switch.

3. The rescue apparatus according to claim 2, wherein the brake control unit comprises a switching state indicator for indicating the switching state of the first controllable brake opening switch and the second controllable brake opening switch.

4. The rescue apparatus according to claim 1, wherein the remote control panel comprises a manually operated mode selection switch connected in series with the one or more drive switches.

5. The rescue apparatus according to claim 1, wherein the power supply is a backup power supply.

6. The rescue apparatus according to claim 5, wherein the power supply is a DC backup power supply, and the brake control unit comprises a DC/DC converter for supplying electricity from the backup power supply to the magnetizing coil.

7. The rescue apparatus according to claim 1, wherein the power supply is mains.

8. The rescue apparatus according to claim 1, wherein the brake control unit further comprises passage terminals for output cables of a normal mode brake control device, wherein the brake control unit further comprises a disconnecting switch fitted between the passage terminals and the output terminals, and wherein control pole of the disconnecting switch is coupled via a control signal wire to the mode selection switch in the remote control panel, such that the disconnecting switch is operable to selectively disconnect or connect the passage terminals to the output terminals based on status of the mode selection switch.

9. The rescue apparatus according to claim 8, wherein the disconnecting switch is a changeover switch having first inputs coupled to the passage terminals, second inputs coupled to the rescue-time current supply and outputs coupled to output terminals.

10. The rescue apparatus according to claim 4, wherein the mode selection switch has a contact in elevator safety chain, and wherein the safety chain contact of the mode selection switch is fitted to be in open state when the mode selection switch is in rescue mode and to be in closed state when the mode selection switch is in normal mode.

11. The rescue apparatus according to claim 10, wherein the rescue apparatus comprises controllable dynamic braking switches having terminals for coupling to a stator winding of a permanent magnet motor, the dynamic braking switches being adapted to generate, in a closed state, a braking current from electromotive force of the permanent magnet motor, and wherein the control pole(s) of the dynamic braking switches are coupled to the elevator safety chain such that the dynamic braking switches are in a closed state when the elevator safety chain is interrupted.

12. The rescue apparatus according to claim 5, wherein the control cable comprises a power supply wire coupled to the backup power supply, and wherein the remote control unit comprises an indicator of backup power supply status.

13. A rescue apparatus for an elevator, the rescue apparatus comprising:

a brake control unit comprising:

input terminals for connecting to a power supply;

output terminals for connecting to a magnetizing coil of an electromagnetic brake; and at least one controllable brake opening switch associated with at least one of the input terminals and adapted, in an open state, to prevent supply of current from the power supply to the magnetizing coil and, in a closed state, to allow supply of current from the power supply to the magnetizing coil:

a control cable comprising one or more control signal wires; and a remote control panel coupled via the control cable to the brake control unit, wherein the remote control panel comprises a manually operated drive switch coupled via the control signal wire to the control pole of the brake opening switch, wherein the brake control unit further comprises a solid state switch associated with the output terminals for selectively preventing or allowing supply of electricity to the magnetizing coil.

14. The rescue apparatus according to claim 13, wherein the at least one controllable brake opening switch includes two controllable brake opening switches, and wherein the brake control unit comprises a safety logic having output coupled to the control pole of the solid state switch and an input coupled to the switching state indicator, for receiving switching state information of the two controllable brake opening switches, the safety logic comprising:

a logic element configured to compare the received switching states of the two controllable brake opening switches and to block power supply to the output terminals in case a first of the two controllable brake opening switches remains in closed state while a second of the two controllable changes from closed state to open state and then returns to the closed state.

15. The rescue apparatus according to claim 13, wherein the brake control unit comprises a modulator coupled to the control pole of the solid state switch, and wherein the modulator is configured to adjust output terminal voltage by modulating the solid state switch.

16. An elevator, comprising:

an elevator car;

a hoisting machine configured to drive the elevator car in an elevator shaft between landings according to service requests from elevator passengers, the hoisting machine including one or more electromagnetic brakes; and the rescue apparatus according to claim 1.

17. The elevator according to claim 16, wherein the remote control unit is disposed in the landing.

18. The elevator according to claim 17, wherein the elevator comprises a normal mode brake controller for controlling the one or more electromagnetic brakes during normal elevator operation, and wherein the hoisting machine, normal mode brake controller, the brake control unit and the backup power supply are disposed is shaft, in close proximity to each other.

19. A retrofit kit comprising:

the rescue apparatus according to claim 1, which is suitable for fitting into an elevator, the elevator comprising:

an elevator car; and a hoisting machine configured to drive the elevator car in an elevator shaft between landings according to service requests from elevator passengers, the hoisting machine including one or more electromagnetic brakes.

20. The rescue apparatus according to claim 2, wherein the remote control panel comprises a manually operated mode selection switch connected in series with the one or more drive switches.

* * * * *